US006174194B1

(12) United States Patent
Bleicher et al.

(10) Patent No.: US 6,174,194 B1
(45) Date of Patent: Jan. 16, 2001

(54) ADD-ON ELECTRICAL ASSEMBLY WITH LIGHT TRANSMISSION MEANS

(75) Inventors: Matthias Bleicher, Weinsberg; Frank Bordron, Heilbronn; Martin Buss, Untergruppenbach; Michael Fasold, Leutenbach; Thomas Hans Foerner, Heilbronn; Michael Follmann, Bad Rappenau; Heinrich Fuchslocher, Mannheim; Gerd Klaiber, Oedheim; Reinhold Muller, Massenbachhausen, all of (DE)

(73) Assignee: Molex Incorporated, Lisle, IL (US)

( * ) Notice: Under 35 U.S.C. 154(b), the term of this patent shall be extended for 0 days.

(21) Appl. No.: 09/310,805

(22) Filed: May 12, 1999

(51) Int. Cl.[7] ..... H01R 13/00
(52) U.S. Cl. ..... 439/490; 439/676
(58) Field of Search ..... 439/488–490, 439/676, 344

(56) References Cited

U.S. PATENT DOCUMENTS

| | | | | |
|---|---|---|---|---|
| 4,379,606 | | 4/1983 | Clark et al. | 339/17 |
| 4,425,018 | | 1/1984 | Stenz | 339/198 |
| 4,457,570 | | 7/1984 | Bogese, II | 339/17 |
| 4,620,070 | * | 10/1986 | Ruehl | 179/175.3 R |
| 4,626,633 | | 12/1986 | Ruehl et al. | 379/27 |
| 4,878,858 | | 11/1989 | Dechelette | 439/607 |
| 4,978,317 | | 12/1990 | Pocrass | 439/490 |
| 5,419,720 | | 5/1995 | Chen | 439/676 |
| 5,478,261 | | 12/1995 | Bogese, II | 439/676 |
| 5,613,873 | | 3/1997 | Bell, Jr. | 439/490 |
| 5,700,157 | | 12/1997 | Chung | 439/490 |
| 5,704,802 | | 1/1998 | Loudermile | 439/490 |
| 5,741,152 | | 4/1998 | Boutros | 439/490 |
| 5,797,767 | * | 8/1998 | Schell | 439/490 |
| 5,876,239 | * | 3/1999 | Morin et al. | 439/490 |
| 5,924,889 | * | 7/1999 | Wang | 439/490 |
| 5,975,943 | * | 11/1999 | Chou et al. | 439/490 |

FOREIGN PATENT DOCUMENTS

| | | |
|---|---|---|
| 0740370A1 | 4/1996 | (EP) . |
| 0817323A1 | 6/1997 | (EP) . |
| 98/09347 | 3/1998 | (WO) . |

* cited by examiner

*Primary Examiner*—Hien Vu
(74) *Attorney, Agent, or Firm*—A. A. Tirva

(57) ABSTRACT

An add-on electrical assembly is provided for association with an electrical connector for receiving a complementary mating plug to a circuit board. The electrical connector may be a standard modular jack including a connector housing having a front face with a receptacle receiving the plug, a top wall, a rear wall and a bottom face adapted for mounting on the circuit board. A plurality of terminals each include one end extending into the receptacle for making electrical contact with a corresponding terminal on the plug and the other end adapted to contact the circuit board. A separate LED assembly is provided with housing for mounting over the top and rear walls of the connector housing. A light emitting device is mounted on the LED housing and is viewable through a front face thereof adjacent the receptacle. Conductors extend from the light emitting device through the LED housing for connection to the circuit board. At least one snap latch is provided between the LED housing and the connector housing.

10 Claims, 9 Drawing Sheets

FIG. 6
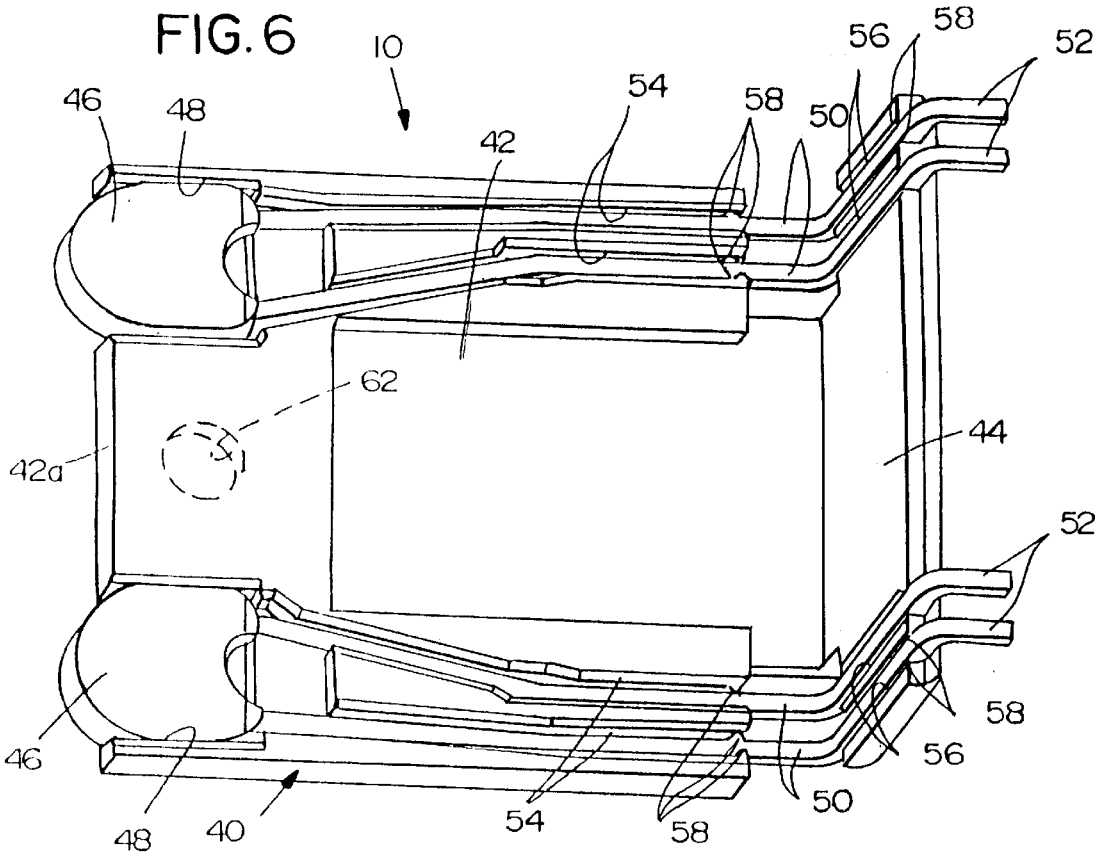
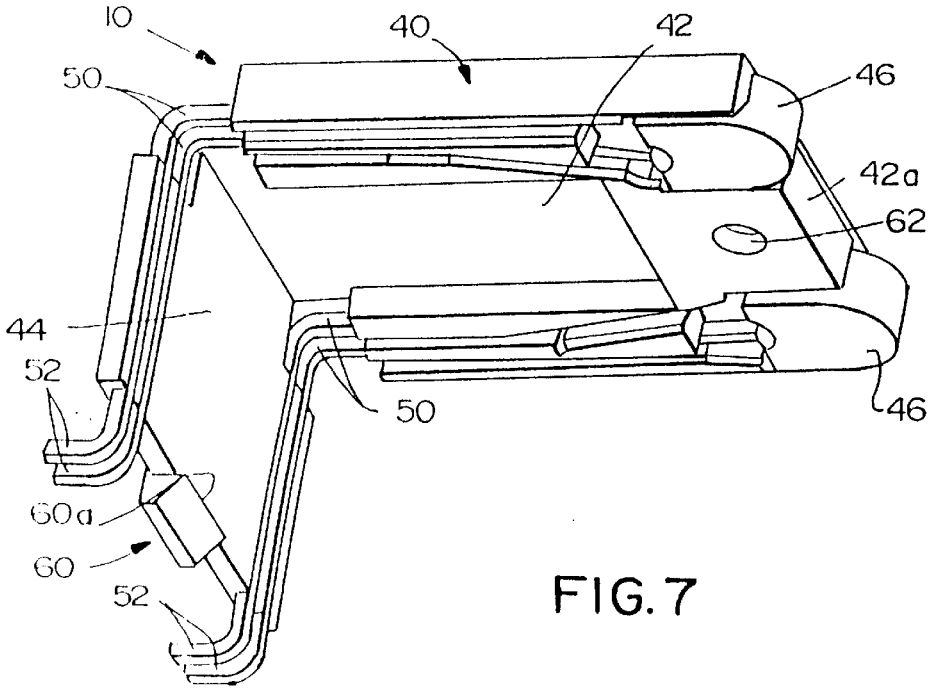
FIG. 7

ADD-ON ELECTRICAL ASSEMBLY WITH LIGHT TRANSMISSION MEANS

FIELD OF THE INVENTION

This invention generally relates to the art of electrical connectors and, particularly, to an add-on electrical connector assembly which has light transmission means for visual indication of the status of an associated electrical connector.

BACKGROUND OF THE INVENTION

Electrical connectors having built-in indicator lights have been known for some time. In these connectors, the indicator lights typically are located at the front of the connector. A typical connector may include an integral LED device to emit a light which indicates an operational function such as the reception or transmission of data or voice signals, verification of a good connection between separate pieces of equipment, indication when power is on or off, indication of a defect in a network transmission or any other state or condition in the equipment with which the connector is operatively associated.

Visual light indicating connectors are popular in modular jacks or similar types of connectors commonly used in telecommunications and data networking equipment. These jacks often are mounted on a circuit board to which they are to be connected. Problems have been encountered in incorporating such light indicating devices, such as LED devices, directly onto the connector due to the ever-increasing miniaturization of telecommunications and data networking equipment. There may simply not be enough space to mount the desired LED devices directly on the connector housing. In addition, regardless of the size of the connector or jack, connectors which include light transmitting devices are expensive to manufacture and assemble for an otherwise relatively inexpensive component. For instance, for an integral LED device the connector or jack housing must be provided with internal molded passages to accommodate the light indicating devices as well as the conductors which lead from the devices. Such provisions might not be practical or cost effective.

The present invention is directed to solving these problems by providing an add-on assembly for an electrical connector or modular jack assembly which provides light indicating capabilities without making the source of the light integral with the connector or modular jack itself.

SUMMARY OF THE INVENTION

An object, therefore, of the invention is to provide a new and improved add-on electrical connector assembly capable of transmitting and indicating light for various visual indication purposes.

In the exemplary embodiment of the invention, a printed circuit board mounted connector assembly is adapted for electrically connecting a complementary mating plug to a printed circuit board. The connector assembly is disclosed as a modular jack assembly.

More particularly, the assembly includes a board mounted connector having a connector housing mounted on the printed circuit board. The housing includes a front face with a cavity therein defining a plug-receiving opening or receptacle, a top wall and a rear wall. A plurality of terminals are mounted on the housing and each terminal includes one end extending into the cavity for making electrical contact with a corresponding terminal on the plug and an opposite end adapted to contact the printed circuit board.

An LED module is provided separate from the board mounted connector for association with the connector housing. The module includes a separate LED housing adapted to be mounted over the top and rear walls of the connector housing. A light emitting device is mounted on the LED housing and is viewable through a front face thereof adjacent the plug-receiving opening. Conductor wires extend from the light emitting device through the interior of the LED housing and downward for connection to the printed circuit board.

As disclosed herein, the LED housing is generally L-shaped to include a top portion adapted to overlie the top wall of the connector housing and a rear portion adapted to overlie the rear wall of the connector housing. The terminals of the connector and the distal ends of the LED conductor wires include feet for surface mounting on the printed circuit board. The feet of the terminals and the conductor wires are generally in a line. In the embodiment shown the light emitting device is snap fit into a recess formed in the bottom of the LED housing, and the conductor wires are snap fit into channels formed in the bottom of the LED housing.

Another feature of the invention includes complementary interengaging retaining means on the LED housing and the connector housing for retaining the LED module mounted on the board mounted connector. The retaining means may provide a snap type releasable latch system. With the L-shaped module housing, the retaining means include a first snap latch near the front of the top wall of the connector housing and a second snap latch near the bottom of the rear wall of the connector housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 6 is another inside perspective view of the LED module taken at a different angle from that of FIG. 5;

FIG. 7 is an inside perspective view of a modified form of a LED module incorporating a retaining feature;

DETAILED DESCRIPTION OF THE PREFERRED EMBODIMENTS

Figure 1:
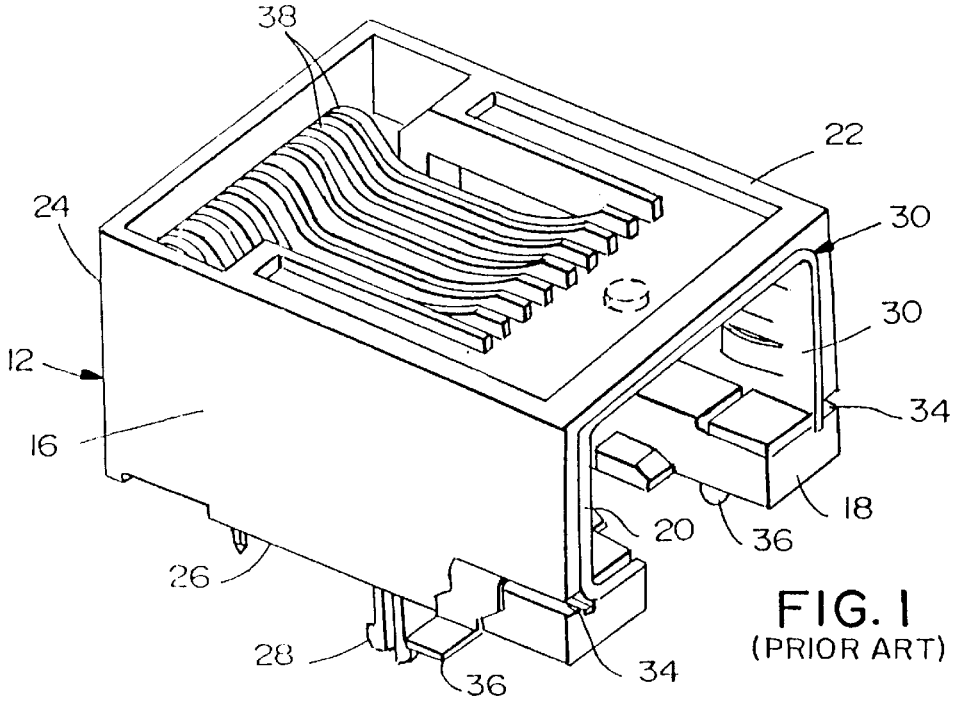
FIG. 1 (PRIOR ART)
FIG. 1 is a perspective view of a prior art shielded board mountable modular jack.
Figure 2:
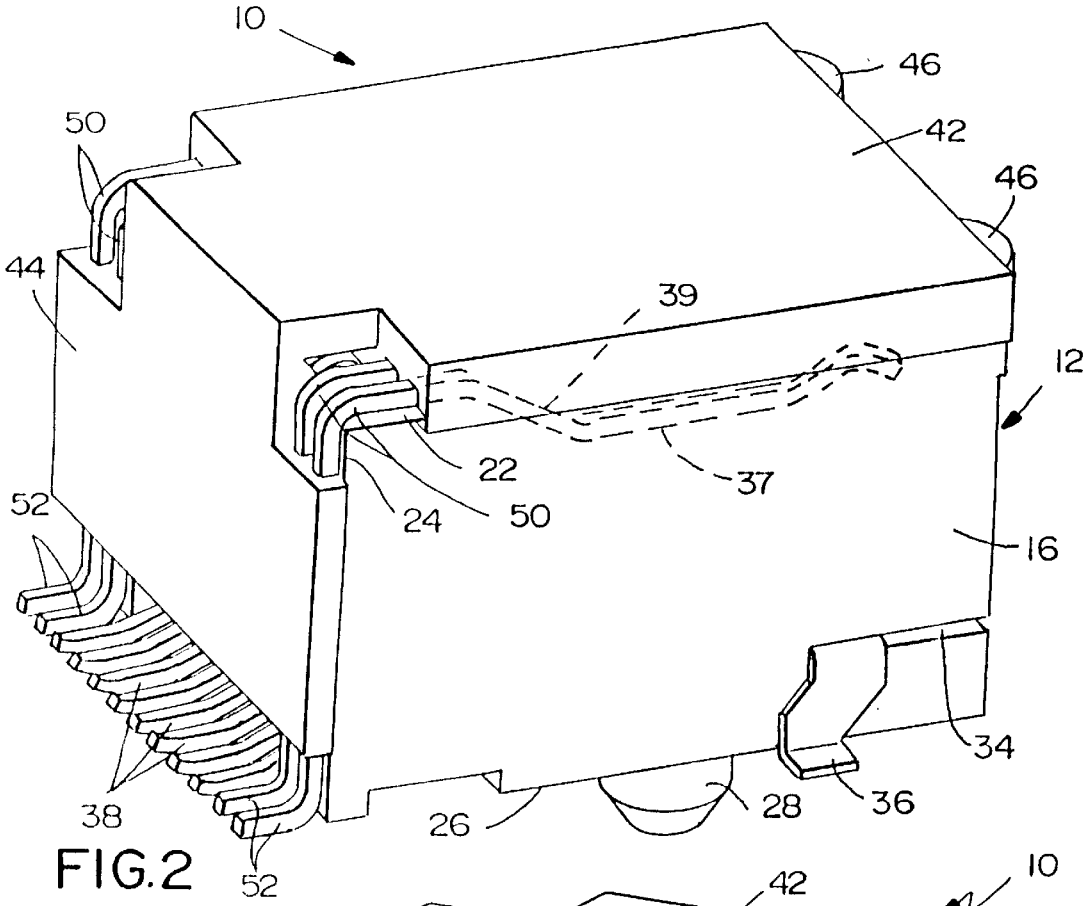
FIG. 2 is a rear perspective view of a first embodiment of a printed circuit board mounted connector associated with an add-on LED module embodying the concepts of the invention.
Figure 3:
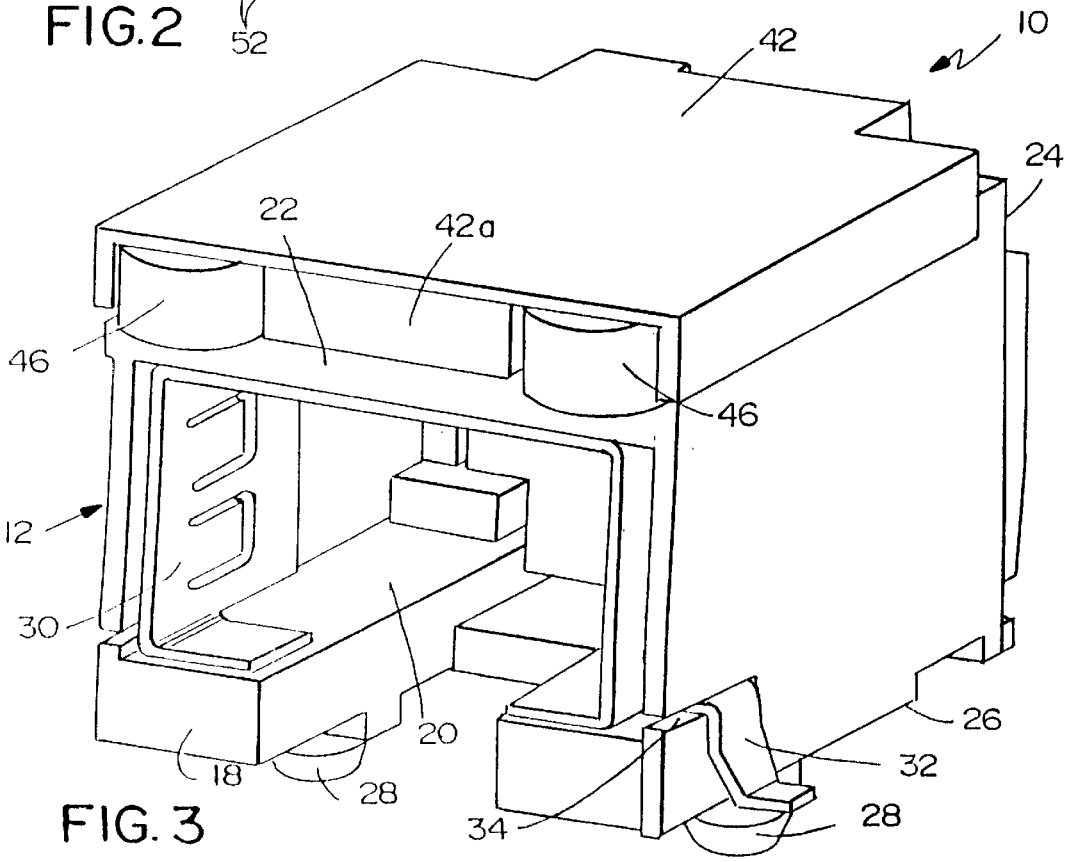
FIG. 3 is a front perspective view of connector assembly with the add-on module of the present invention in place on top of the modular jack.

Referring to the drawings in greater detail, and first to FIGS. 1, 2, and 3 the invention is embodied in a LED module 10 shown associated with a printed circuit board mounted connector assembly, generally designated 12. The connector assembly is in the form of a modular jack adapted for electrically connecting a complementary mating plug (not shown) to a printed circuit board (not shown) as is known in the art.

According to our aspect of the invention, the LED module 10 is separate from the modular jack 12 and, as best seen in FIG. 2, the separate LED module generally overlies the top and rear surfaces of the modular jack such as a prior art modular jack shown in FIG. 1.

More particularly, modular jack 12 is of a convention design and includes a housing 16 having a front face 18 (FIG. 1 and 3) defining a cavity 20 which forms a plug-receiving opening or receptacle for the complementary mating plug. The housing further includes a top wall 22, a rear wall 24 and a bottom face 26 adapted for mounting on the circuit board. To that end, the housing includes a pair of integral mounting posts 28 depending from bottom face 26 for insertion into appropriate mounting holes in the circuit board. As best seen in FIG. 1 and 2, a conductive shroud 30 may be positioned about the inside of receptacle 20 to define a shield for engaging a grounding shield of the mating plug. The shroud or shield 30 has a pair of legs 32 projecting through slots 34 in the side walls of housing 16, with the legs terminating in generally planar feet or "fitting nails" 36 for solder connection to appropriate ground pads on the circuit board.

A plurality of terminals 39 are mounted within connector or jack housing 16 for electrically connecting the complementary mating plug to circuit traces on the circuit board. Such terminals are well known in the art and include inner ends 37 which extend in a cantilevered fashion into receptacle 20 for making electrical contact with corresponding terminals on the complementary mating plug. Opposite ends of the terminals project from the housing as at 38 in FIG. 2 for solder connection to appropriate circuit traces on the circuit board. As shown, ends 38 of the terminals are provided as feet for surface mounting to the circuit traces on the board. The surface mount feet are generally in a line.

Figure 4:
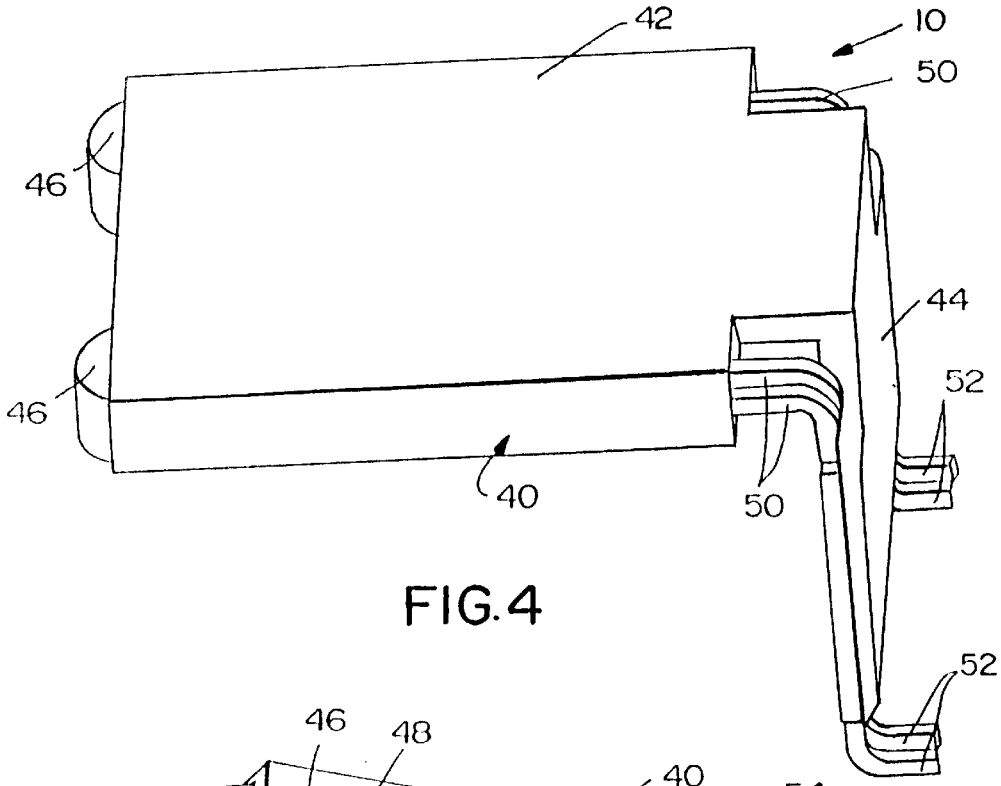
FIG. 4 is an outside perspective view of a LED module embodying the concepts of the invention.
Figure 5:
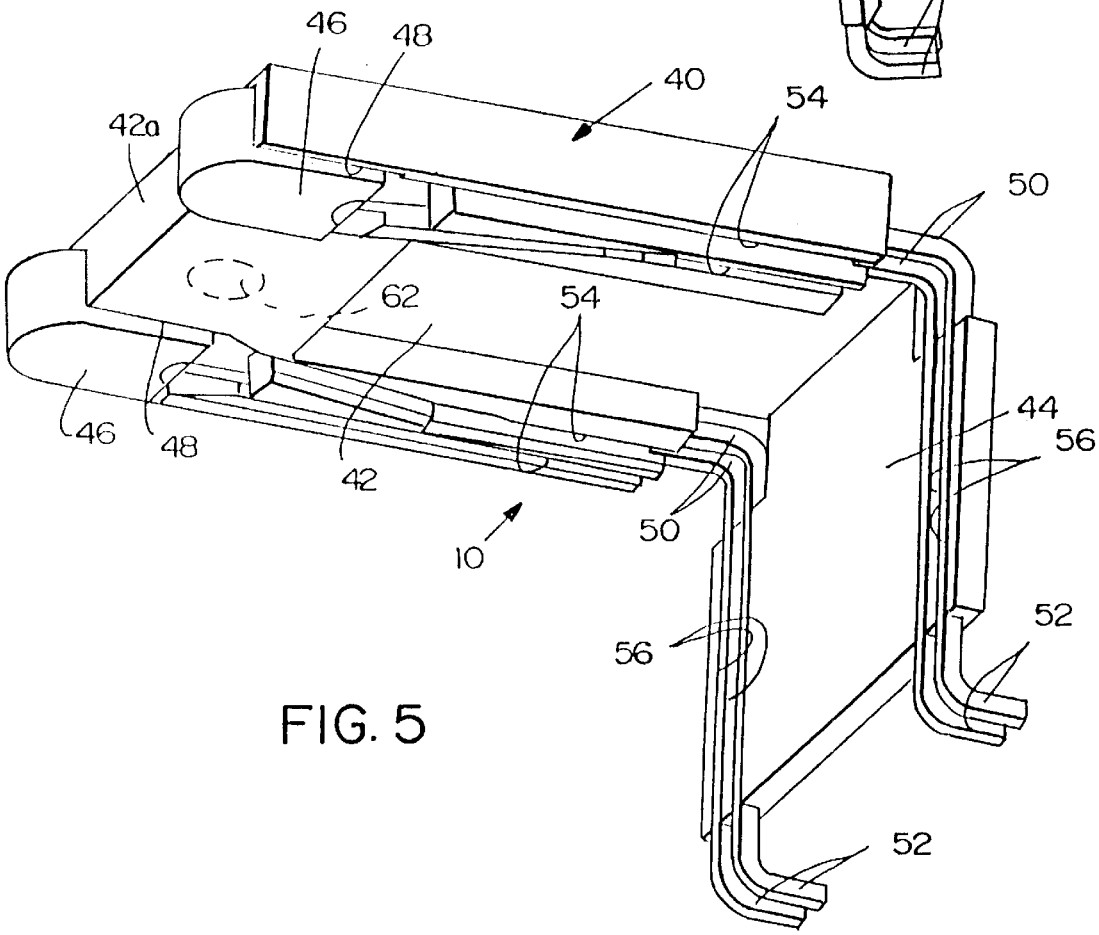
FIG. 5 is an inside perspective view of the LED module.

Referring to FIGS. 4 and 5 in conjunction with FIGS. 2 and 3, the LED module 10 includes a dielectric housing, generally designated 40, which is generally L-shaped to include a top portion 42 and a rear portion 44. The separate LED module then can be associated with, including mounting directly thereto, the top of modular jack housing 16 with top portion 42 over top wall 22 of the jack housing and rear portion 44 over rear wall 24 of the jack housing, as shown in FIG. 2. LED housing 40 can be unitarily molded of dielectric material such as plastic or the like.

Still referring to FIGS. 4 and 5, LED module 10 includes a pair of light emitting devices 46 which are snap-fit into recesses 48 in the bottom of LED housing 40 as seen in FIG. 5. The recesses and, therefore, the light emitting devices are located at a front face 42*a* of top portion 42 of the LED housing so that the devices are viewable through front face 42*a* adjacent receptacle 20 of modular jack 12, as shown in FIG. 3.

Generally, a pair of conductors 50 extend from each light emitting device 46 through the interior of LED housing 40 and downward for connection to the printed circuit board. The conductors terminate in feet 52 adapted for surface mounting to circuit traces on the printed circuit board. Feet 52 of conductors 50 can be seen in FIG. 2 to be in line with terminal feet 38.

More particularly, referring to FIG. 6 in conjunction with FIG. 5, a pair of channels 54 are formed in the bottom of top portion 42 of LED housing 40, and a pair of channels 56 are formed in rear portion 44 of the LED housing to accommodate each pair of conductors 50 leading from each light emitting device 46. FIG. 6 shows that detent bosses 58 can be formed to project inwardly into channels 54 and 56 to facilitate snapping or press fitting the conductors into the channels and retaining the conductors therein. Therefore, it can be understood that separate LED module 10 can be easily assembled by simply snapping or press-fitting light emitting devices 46 into recesses 48 and snapping or press fitting conductors 50 into channels 54 and 56. The recesses and channels can be very easily molded into LED housing 40. The subassembly of LED module 10 then is simply positioned onto the top and rear of modular jack 12 as seen in FIGS. 2 and 3.

With the simple and inexpensive connector or jack assembly described above, various options are available for retaining the LED module on the connector or jack housing 16. For instance, with the jack housing also being unitarily molded of dielectric material such as plastic or the like, the plastic LED housing simply can be ultrasonically welded to the plastic jack housing. Of course, this would provide a permanent retention. On the other hand, it may be desirable to releasably mount the LED module onto the modular jack with a releasable retention system as shown in FIGS. 7 and 8.

Figure 8:
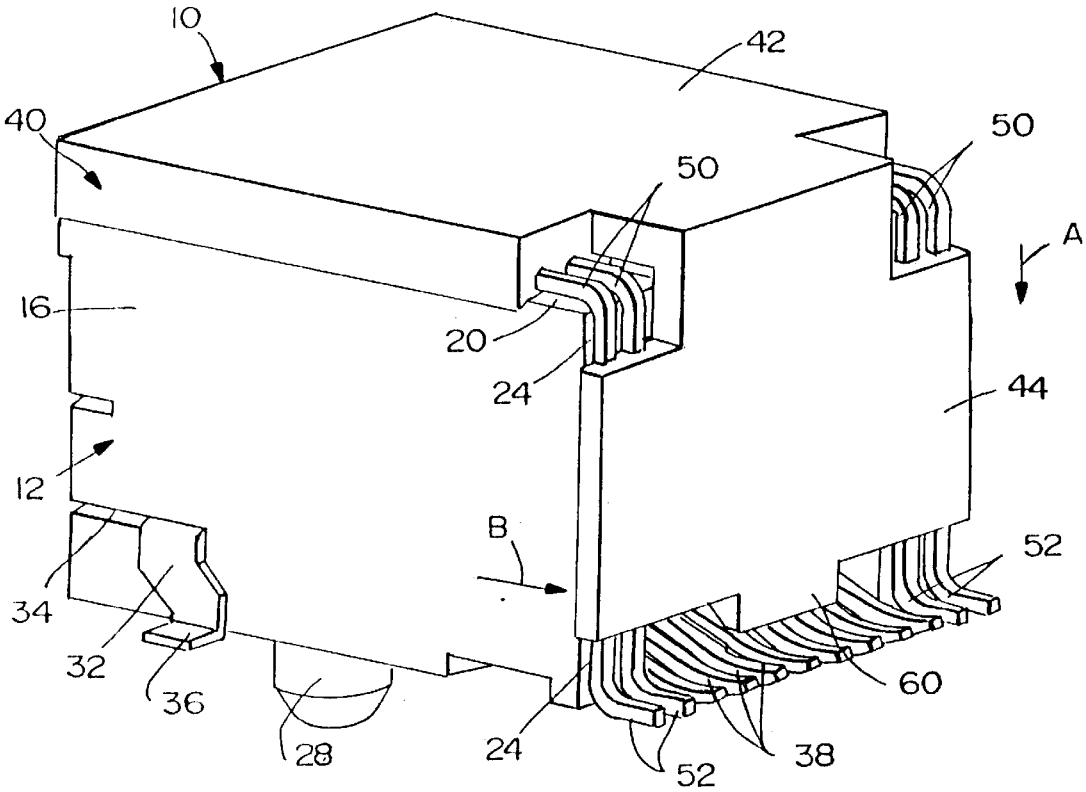
FIG. 8 is a perspective view of the LED module of FIG. 7 snapped in place on a modular jack assembly.

More particularly, the embodiment of FIGS. 7 and 8 show that a snap-latch clip 60 can be molded integrally with rear portion 44 of LED housing 40. The clip defines an inwardly directed hook 60*a* which can snap beneath a bottom edge of rear wall 24 of modular jack housing 16. Top wall 22 of the modular jack housing can be provided with an integral, upstanding boss as shown in phantom in FIG. 1 for insertion into a hole 62 in the underside of top portion 42 of the LED housing, as by a press-fit. With such an arrangement the separate LED module 10 can be assembled downwardly onto modular jack 12 in the direction of arrow "A" (FIG. 8) whereupon the post on the top of the modular jack enters hole 62 of the LED module, and retention clip 60 snaps behind a bottom edge of the front wall of the modular jack. If it is desired to remove the LED module for inspection, repair or other purposes, the lower edge of the rear portion 44 simply is pulled outwardly in the direction of arrow "B" (FIG. 8) to clear retention clip 60 from the front wall of the modular jack, and LED module 10 simply is lifted off of the modular jack opposite the direction of arrow "A".

Even without retention clip 60, the embodiment of FIGS. 1–5 may include hole 62 on the underside of top portion 42 of LED housing 40 as shown in phantom in FIGS. 5 and 6, simply to receive a locating post upstanding from jack housing 16.

FIGS. 9–13 show another embodiment of a printed circuit board mounted connector assembly in the form of an LED module 10 associated with a modular jack 12 adapted for electrically connecting a complementary mating plug (not shown) to a printed circuit board (not shown) as is known in the art. Like the connector assembly in FIGS. 2 and 3, the connector assembly of FIGS. 9–13 includes two major subassemblies, namely a board-mounted connector or jack, generally designated 12 and an LED module, generally designated 10. Again, the LED module is separate from the modular jack. The separate LED module is generally L-shaped and mounted over the top and rear of modular jack 12.

Because of the similarities between the connector in FIGS. 9–13 and the connector in FIGS. 2–8, like reference numerals will be applied throughout all of FIGS. 9–15 corresponding to like elements described above and referenced in FIGS. 2–8. The major differences between the features of the connector assembly of FIGS. 9–15 and the connector assembly of FIGS. 2–8 reside in the arrangement of the retaining means or latches as well as the light emitting components, as described hereinafter.

Figure 9:
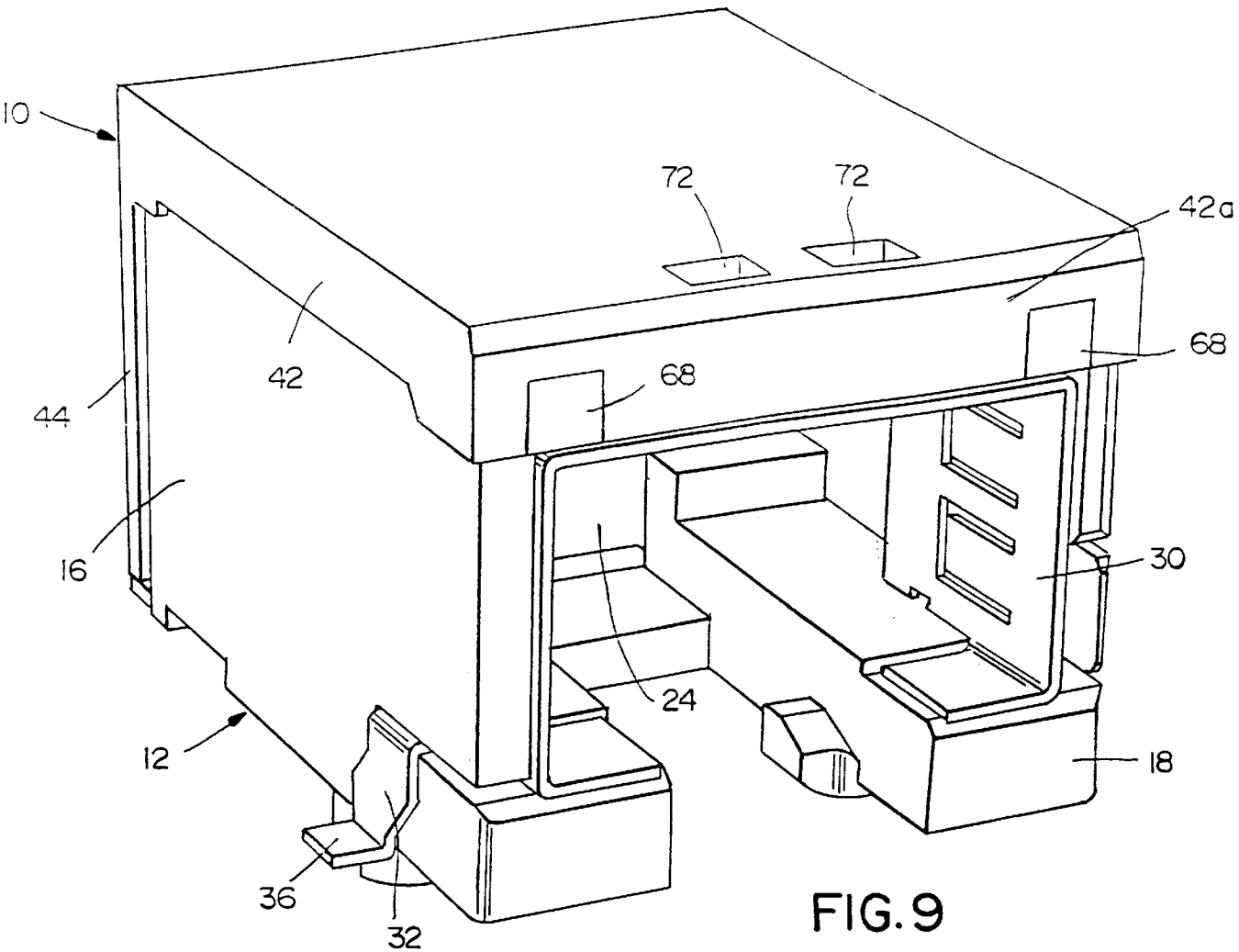
FIG. 9 is a top front perspective view of another embodiment of a connector assembly incorporating the concepts of the invention.
Figure 10:
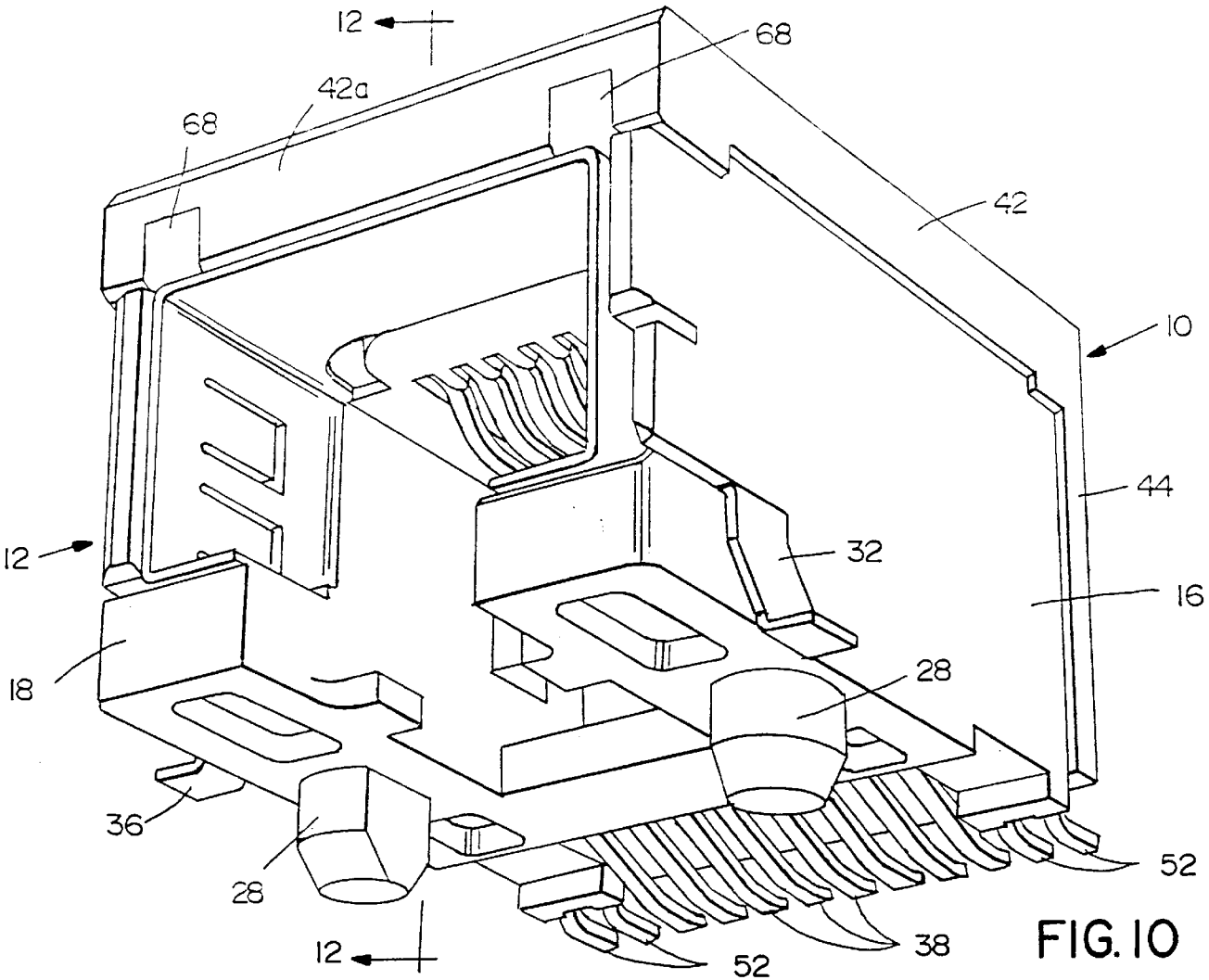
FIG. 10 is a bottom front perspective view of the assembly of FIG. 9.
Figure 11:
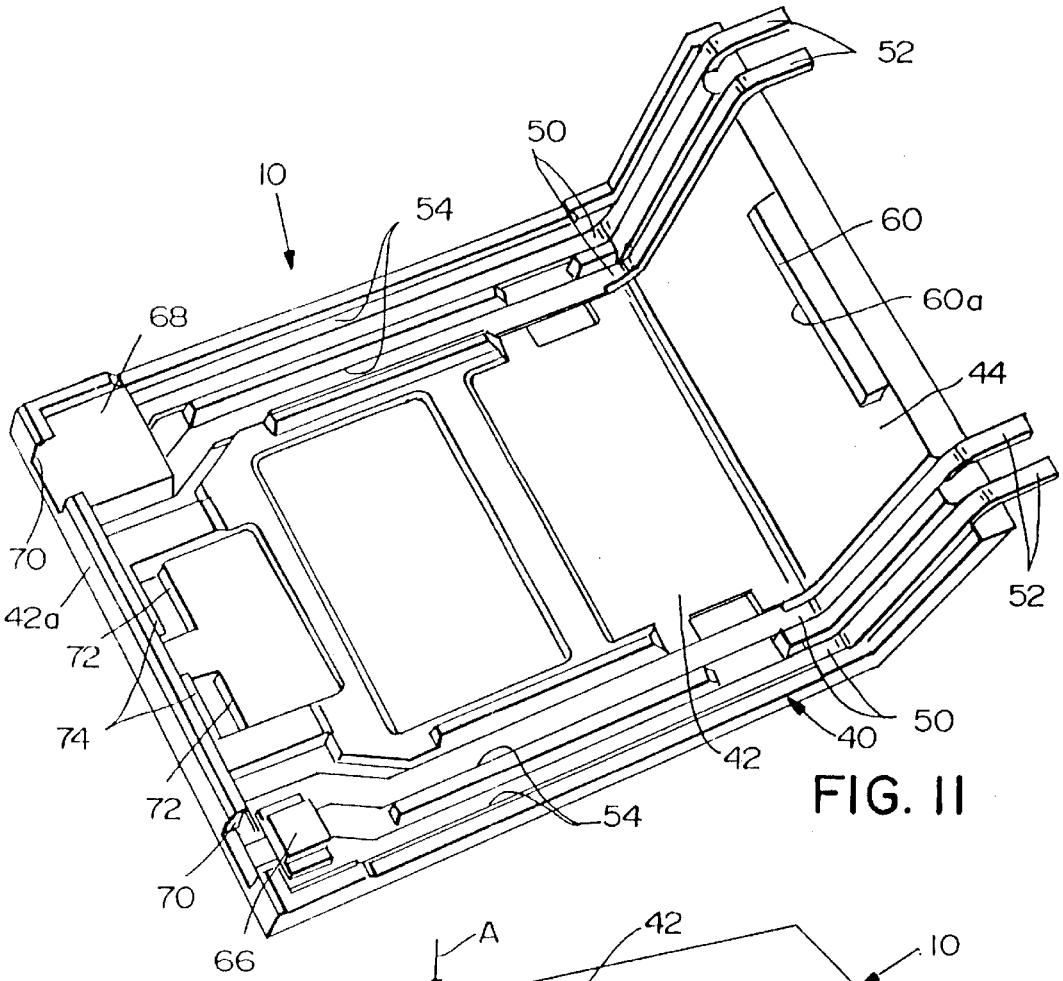
FIG. 11 is an inside perspective view of the LED module for the embodiment of FIG. 9.

More particularly, referring to FIG. 11 in conjunction with FIGS. 9 and 10, LED module 10 includes a light emitting device (LED) 66 covered by a light diffusing block 68. One of the LED's and diffusing block assemblies is mounted within each front corner of the LED module. The LED's are connected to conductors 50, and portions of the diffusing blocks are exposed through openings 70 in front face 42*a* of the LED housing.

FIG. 11 shows that LED module 10 has a modified form of retaining means or snap latch arrangement. Specifically, like the embodiment of FIGS. 7 and 8, a snap-latch flange or clip 60 is molded integrally along the bottom edge of rear portion 44 of LED housing 40. The latch flange defines an inwardly direct hook 60*a*. A pair of latch holes 72 are formed in top portion 42 of the LED housing immediately behind front face 42*a* thereof. A latch rib 74 projects inwardly of each latch hole 72.

Figure 12:
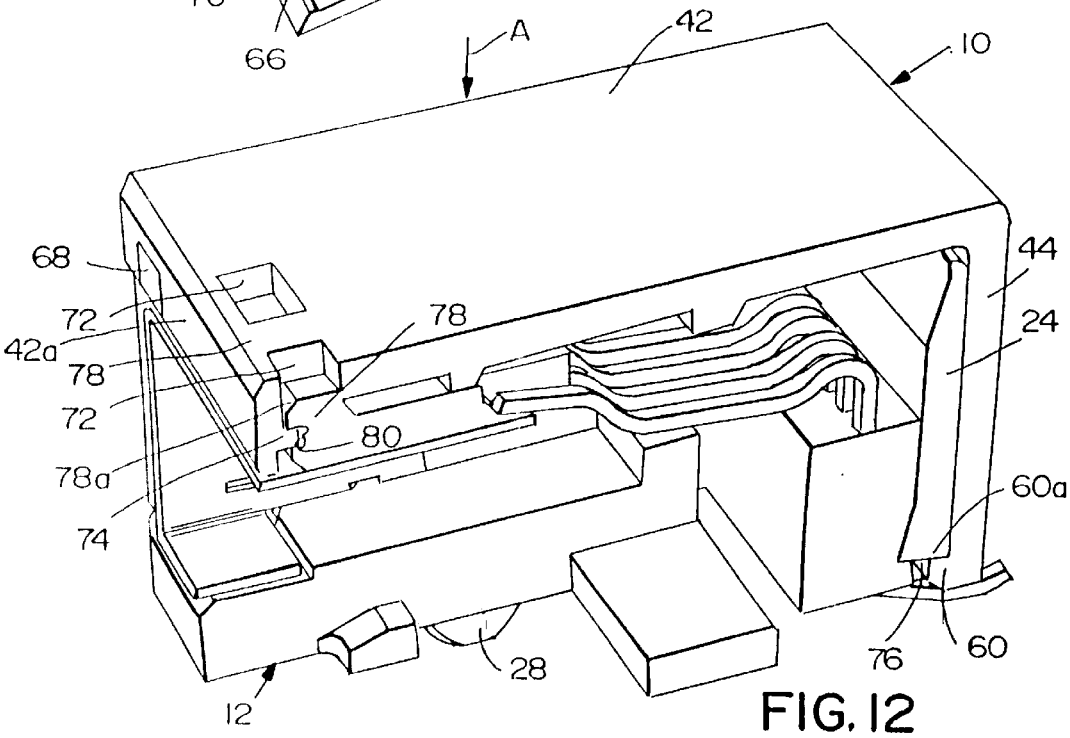
FIG. 12 is a sectional perspective view taken generally along line 12—12 of FIG. 10.
Figure 13:
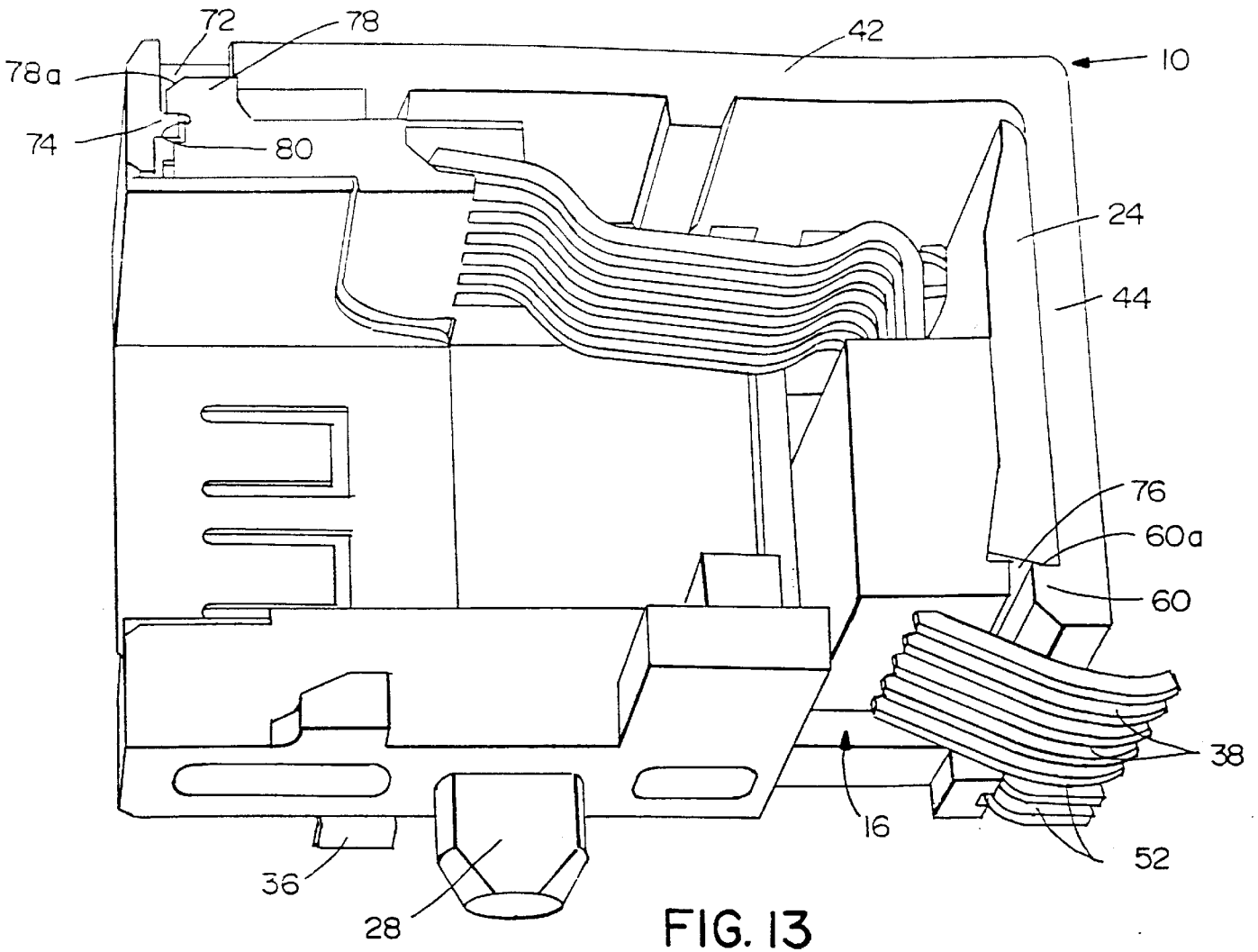
FIG. 13 is a sectional perspective similar to that of FIG. 12, but at a different angle.

Turning to FIGS. 12 and 13, LED module 10 (FIG. 11) is mounted on modular jack 12 in the direction of arrow "A" (FIG. 12). When the housing of the LED module is snapped into latching engagement with the housing of the modular jack, hook 60*a* of latch flange 60 snaps behind a bottom edge 76 of rear wall 24 of modular jack housing 16. In addition, a pair of latch bosses 78 project upwardly from the front top corner of the modular jack housing and enter latch holes 72 at the front of the LED housing. A latch groove 80 is formed in the front face of each latch boss 78 for receiving the latch rib 74 within the respective latch hole 72 of the LED housing. The top front corner 78*a* of each latch boss 78 is chamfered or rounded so that latch ribs 74 ride over the latch bosses and snap into latch grooves 80.

In an alternative mounting method, the module 10 may be initially tilted a slight angle allowing lateral ribs 78 to enter respective grooves 80 and then the module may be rotated into latching engagement with the housing of the modular jack.

Figure 14:
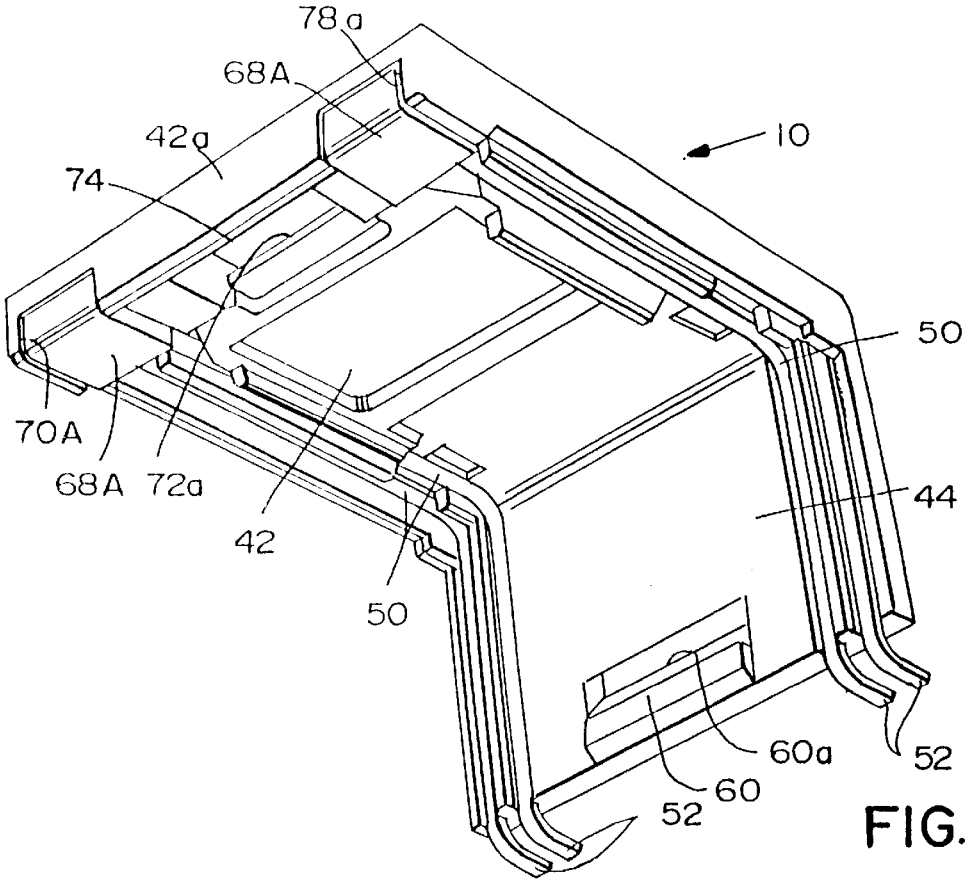
FIG. 14 is an inside perspective view similar to that of FIG. 11, but of a slightly modified LED and latch configuration.

FIG. 14 shows a modified form of LED module wherein a pair of diffusing blocks 68A are provided and are exposed through openings 70A in front face 42*a* of the LED housing. Openings 78*a* are larger than openings 70 in FIG. 11 to expose greater portions of diffusing blocks 68A. In addition, LED module 10 in FIG. 14 has a single latch hole 72A and a corresponding single latch rib 74A, versus the two latch holes 72 and corresponding two latch ribs 74 of the module embodiment shown in FIG. 11. Of course, the modular jack housing would have a single latch boss for projecting into the single latch hole 72A.

Figure 15:
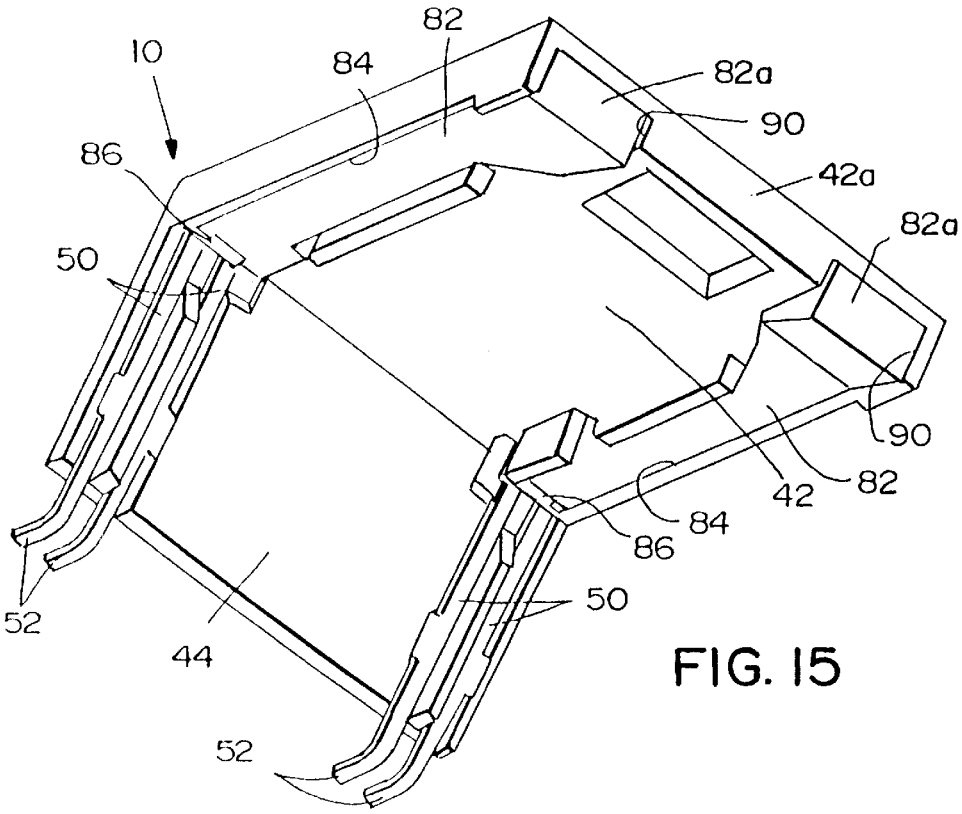
FIG. 15 is an inside perspective view of a further modified form of LED module incorporating light pipes within the top of the module.

Finally, FIG. 15 shows a form of LED module, generally designated 10, which includes a pair of elongated light pipes 82 embedded within elongated recesses 84 within top portion 42 of the LED housing. LED's 86 are disposed within the LED housing near the juncture of the top portion 42 and rear portion 44 thereof. The LED's are electrically connected to conductors 50. Each light pipe 82 has a front face 82*a* exposed through an opening 90 in front face 42*a* of the LED housing. Light pipes 82, as well as diffusing blocks 68 and 68*a* are homogeneous structures fabricated of such materials as a substantially clear polycarbonate material.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A LED module for mounting on a printed circuit board and a connector assembly for electrically connecting a complementary mating plug to the printed circuit board, the connector assembly having a connector housing for mounting on the printed circuit board, the housing including a front face with cavity therein defining a plug-receiving opening, a top wall and a rear wall, and a plurality of terminals each including one end extending into the cavity to make electrical contact with a corresponding terminal on the plug within the cavity and the other end adapted to contact the printed circuit board, wherein the LED module comprises:

a separate one piece generally L-shaped LED housing including a top portion mounted over the top wall of the connector housing and a rear portion mounted over the rear wall of the connector housing the top portion having top and bottom surfaces, a light emitting device mounted in said LED housing and viewable through a front face thereof adjacent the plug-receiving opening, conductors connecting and extending from said light emitting device through the interior of the LED housing and downwardly for connection to the printed circuit board; and wherein said light emitting device is snap fit into a recess formed in the bottom surface of the top portion of the LED housing, and said conductors are snap fit into channels formed in the bottom surface of the top portion of LED housing.

2. The LED module of claim 1 wherein said other ends of the terminals and distal ends of said conductors include feet for surface mounting on the printed circuit board.

3. The LED module of claim 2 wherein said feet of the terminals and the conductors are generally in a line.

4. The LED module of claim 1, including complementary interengaging retaining means on the LED housing and the connector housing for retaining the LED module mounted on the board mounted connector.

5. The LED module of claim 4 wherein said retaining means include a first snap latch near the front of the top wall of the connector housing and a second snap latch near the bottom of the rear wall of the connector housing.

6. A modular jack assembly mounted on a printed circuit board for electrically connecting a complementary mating plug to a circuit board, said modular jack comprising:

a jack housing having a front face with a receptacle for receiving the plug, a top wall, a rear wall and a bottom wall having a bottom face for mounting on the circuit board;

a plurality of terminals each including one end extending into the receptacle for making electrical contact with a corresponding terminal on the plug and the other end adapted to contact the circuit board;

a separate one piece generally L-shaped LED housing including a top portion mounted over the top wall of the connector housing and a rear portion mounted over the rear wall of the connector housing the top portion having top and bottom surfaces;

a light emitting device mounted in the LED housing and viewable through a front face thereof adjacent the receptacle;

conductors connecting and extending from the light emitting device through the LED housing for connection to the circuit board; and wherein said light emitting device is snap fit into a recess formed in the bottom surface of the LED housing, and said conductors are snap fit into channels formed in the bottom surface of the LED housing.

7. The modular jack assembly of claim 6 wherein said other ends of the terminals and distal ends of said conductors include feet for surface mounting on the printed circuit board.

8. The modular jack assembly of claim 7 wherein said feet of the terminals and the conductors are generally in a line.

9. The modular jack assembly of claim 6, including complementary interengaging retaining means between the jack housing and the separate LED housing.

10. The modular jack assembly of claim 9 wherein said retaining means include a first snap latch near the front of the top wall of the connector housing and a second snap latch near the bottom of the rear wall of the connector housing.

* * * * *